US007188671B2

(12) United States Patent
Al-Zahrani

(10) Patent No.: US 7,188,671 B2
(45) Date of Patent: Mar. 13, 2007

(54) SYSTEM, METHOD, AND APPARATUS FOR SURVEY TOOL HAVING ROLLER KNUCKLE JOINTS FOR USE IN HIGHLY DEVIATED HORIZONTAL WELLS

(75) Inventor: Mufrih Saad Al-Zahrani, Dammam (SA)

(73) Assignee: Saudi Arabian Oil Company, Dhahram (SA)

( * ) Notice: Subject to any disclaimer, the term of this patent is extended or adjusted under 35 U.S.C. 154(b) by 310 days.

(21) Appl. No.: 10/958,459

(22) Filed: Oct. 5, 2004

(65) Prior Publication Data

US 2006/0070733 A1 Apr. 6, 2006

(51) Int. Cl.
*E21B 17/02* (2006.01)
*E21B 47/01* (2006.01)

(52) U.S. Cl. ..... 166/250.01; 166/50; 166/66; 166/241.5; 166/241.6

(58) Field of Classification Search ..... 166/241.5, 166/241.6, 241.1, 241.7, 50, 66, 250.01; 175/45, 320, 325.1, 325.3, 325.5, 325.7
See application file for complete search history.

(56) References Cited

U.S. PATENT DOCUMENTS

| | | | | |
|---|---|---|---|---|
| 3,216,751 | A * | 11/1965 | Der Mott | 285/264 |
| 3,817,336 | A * | 6/1974 | Sears | 175/61 |
| 3,930,545 | A * | 1/1976 | Sears | 175/45 |
| 4,570,709 | A | 2/1986 | Wittrisch | |
| 4,699,224 | A | 10/1987 | Burton | |
| 4,793,412 | A * | 12/1988 | Rivas et al. | 166/241.3 |
| 4,842,059 | A | 6/1989 | Tomek | |
| 5,210,533 | A | 5/1993 | Summers et al. | |
| 5,358,042 | A * | 10/1994 | Stoltz | 166/241.6 |
| 5,808,191 | A | 9/1998 | Alexy, Jr. et al. | |
| 5,975,208 | A | 11/1999 | Brooks | |
| 6,755,257 | B2 | 6/2004 | Spencer et al. | |
| 2001/0043838 | A1 | 11/2001 | Baugh et al. | |
| 2002/0129945 | A1 | 9/2002 | Brewer et al. | |
| 2003/0075321 | A1 | 4/2003 | Hall | |

FOREIGN PATENT DOCUMENTS

| | | |
|---|---|---|
| WO | WO 92/01856 | 2/1992 |
| WO | WO 02/066779 A1 | 8/2002 |

OTHER PUBLICATIONS

"Production Knuckle Joint—Ball Type", SONDEX Wireline Ltd., Ver 2.0, Nov. 19, 2003, Printed Nov. 19, 2003, www.sondex.co.uk, email: sondex@sondex.co.uk.

* cited by examiner

*Primary Examiner*—Kenneth Thompson
(74) *Attorney, Agent, or Firm*—Bracewell & Giuliani LLP

(57) ABSTRACT

A highly flexible, wireline survey tool has roller knuckle joints that enable the survey tool string to penetrate and survey horizontal wells having inclinations of about 80° and more from vertical. The survey tool string includes a nose, roller stems, roller knuckle joints, and a highly accurate electronic gauge embedded in a roller cage. Each component has external wheels that are free to contact and roll when they make contact with the inner surfaces of the well. The wheels act as both friction-reducing elements and stand-offs for the survey tool string with respect to the inner surfaces of the well.

26 Claims, 3 Drawing Sheets

SYSTEM, METHOD, AND APPARATUS FOR SURVEY TOOL HAVING ROLLER KNUCKLE JOINTS FOR USE IN HIGHLY DEVIATED HORIZONTAL WELLS

BACKGROUND OF THE INVENTION

1. Technical Field

The present invention relates in general to wireline survey tools and, in particular, to an improved system, method, and apparatus for enabling a wireline survey tool with roller knuckle joints to penetrate and survey highly inclined horizontal wells having an angle of inclination in excess of about 60° from vertical.

2. Description of the Related Art

In horizontal wells, surveys for well parameters, such as temperature and pressure, are typically conducted to identify casing leaks, free gas entry into perforations, etc. A conventional survey tool string has a shock absorber on its leading end, long weight stems (e.g., five to seven feet in axial length), standard knuckle joints, and exposed gauges for measuring the various well parameters.

It is not uncommon to encounter a horizontal inclination that exceeds 50° from the initial vertical orientation of the well. The ability to conduct surveys in these types of wells with a conventional wireline tool is proven, but is limited to inclinations of less than 60°. At inclinations of about 60° or more, the weight and flexibility of the survey tool string is insufficient to overcome the friction and interference between the survey tool string and the well. Moreover, if a wireline operator is inattentive when encountering such deviated conditions, the wireline can coil inside the downhole tubing of the well and be accidentally cut.

These problems make it difficult for production engineers to identify the condition of a well, especially in critical areas such as the interfaces of differing strata, in order to take the necessary action to avoid the loss of hydrocarbons. Thus, an improved solution for reaching highly inclined horizontal wells with wireline survey tools is needed.

SUMMARY OF THE INVENTION

One embodiment of a system, method, and apparatus for a highly flexible, wireline survey tool having roller knuckle joints enables the survey tool string to penetrate and survey horizontal wells having inclinations of about 80° and more (up to about 85°) from vertical, even at depths in excess of 7000 feet. The present invention allows production engineers to conduct surveys, such as for temperature and/or pressure, in highly inclined oil wells having small radii of curvature (e.g., about 10 feet) to help determine the condition of such wells.

A survey tool string constructed in accordance with the present invention comprises a series of components such as a nose, roller stems, roller knuckle joints, and a highly accurate electronic gauge embedded in a roller cage within the string. Each component is provided with a plurality of external wheels that are free to roll when they make contact with the inner surfaces of the well. The wheels act as both friction-reducing elements and stand-offs for the survey tool string with respect to the inner surfaces of the well. The stand-off feature of the survey tool enables the gauge to make more accurate surveys. The wheels may be provided in a variety of geometric configurations depending upon the application. In one embodiment, the wheels are driven by a motor, rather than free-rolling, to further enhance the ability of the string to survey highly inclined horizontal wells.

In addition, each component and the overall string itself is much shorter in axial length than prior art designs. For example, the roller stems are less than two feet long rather than the typical five to six foot lengths of prior art weight stems. One embodiment of the roller knuckle joints and the nose, which are each about one foot long or less, also have multiple degrees of freedom in rotational and bending flexibility.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
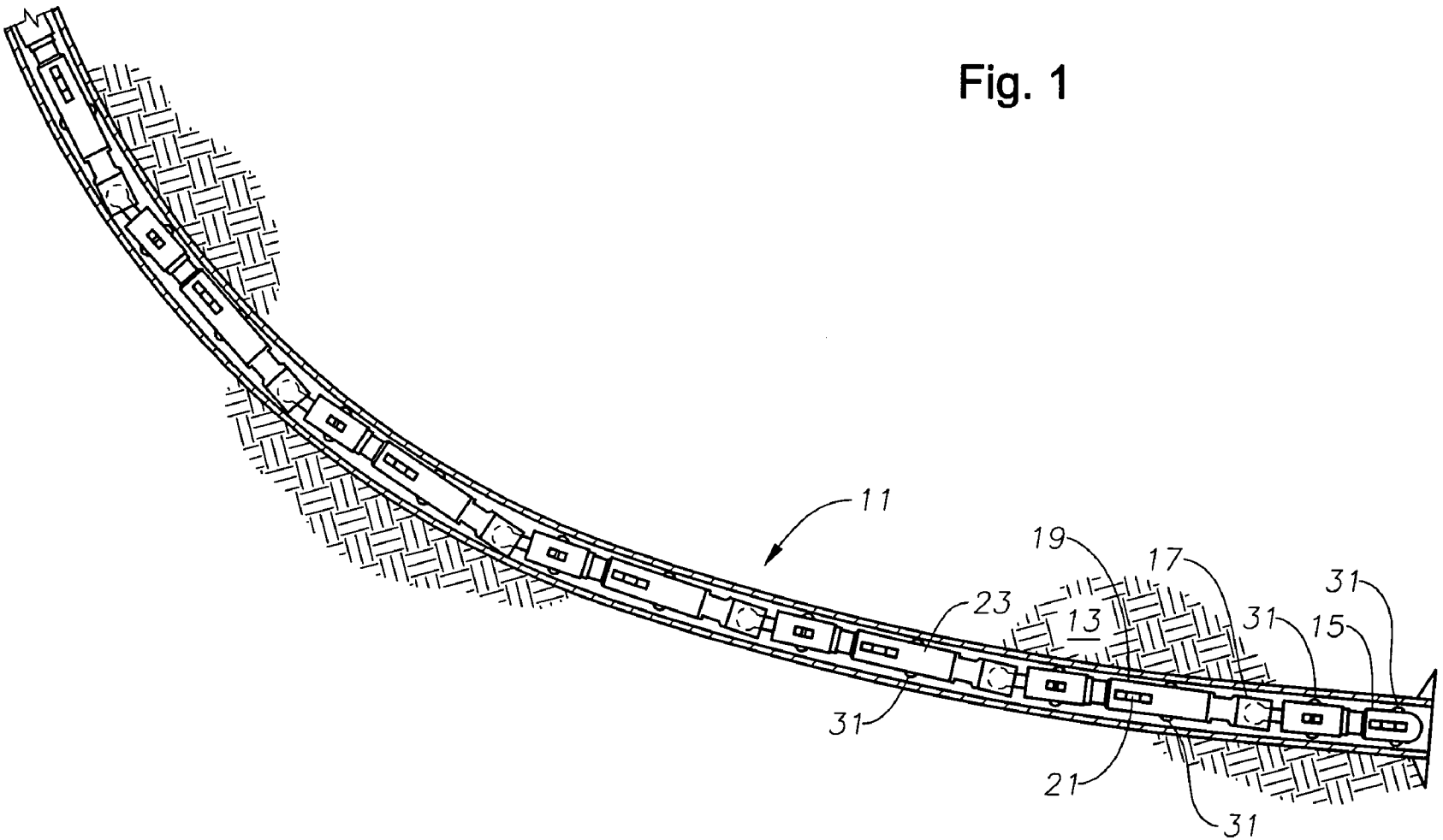
FIG. 1 is a sectional view of one embodiment of a survey tool in a highly deviated well and is constructed in accordance with the present invention.
Figure 2:
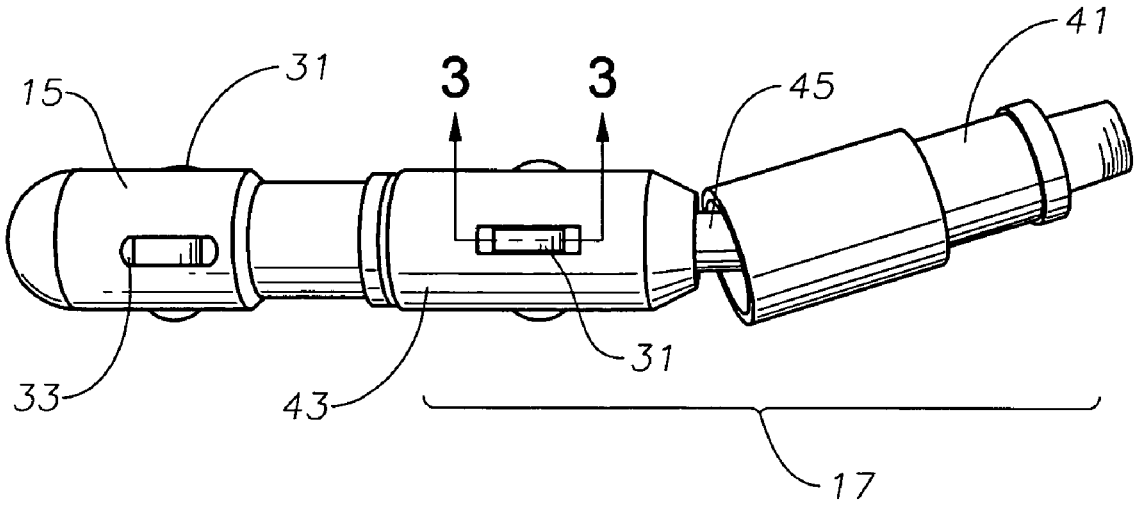
FIG. 2 is a side view of a nose and knuckle joint portion of the survey tool of FIG. 1 and is constructed in accordance with the present invention.
Figure 3:
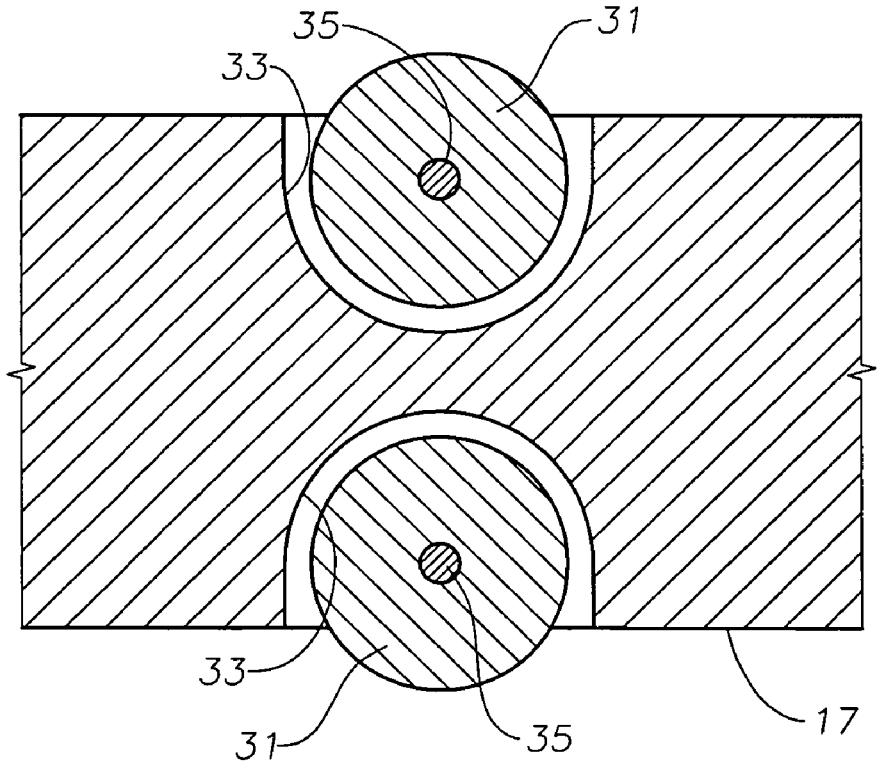
FIG. 3 is a sectional view of a roller assembly portion of the knuckle joint of FIG. 2 taken along the line 3—3 of FIG. 2, and is constructed in accordance with the present invention.

Referring to FIGS. 1–3, one embodiment of a wireline survey tool 11 for surveying a highly deviated (e.g., about 60° to 85° from vertical) horizontal well 13 is shown. The tool 11 comprises a nose 15, at least one knuckle joint 17, and an instrument housing 19. In the version shown, one knuckle joint 17 is located between and is connected to the nose 15 and the instrument housing 19. The nose 15, which typically has a rounded lower end, articulates relative to the instrument housing 19 via knuckle joint 17 with multiple degrees of freedom in rotational and bending flexibility.

The instrument housing 19 contains an electronic gauge 21 for measuring one or more parameters of the well 13, such as temperature and/or pressure. Tool 11 also typically includes at least one weight bar 23 for adding weight to the tool 11. In one embodiment, each of the weight bars 23 has an axial or longitudinal length that is greater than a length of one of the knuckle joints 17.

Collectively, any assortment or configuration of the nose 15, the knuckle joints 17, the instrument housing 19, and the weight bars 23 are referred to as "the components." The components may be configured in many different sequences depending on the application. Although FIG. 1 shows the three of the components in an alternating pattern with the knuckle joints 17, they are not limited to this arrangement. However, typically, tool 11 comprises a single nose 15 at the distal end of the tool 11, a single instrument housing 19, and a knuckle joint 17 located between adjacent ones of the nose 15, the instrument housing 19, and the weight bars 23. This arrangement facilitates extensive articulation of the components relative to one another in order to better penetrate deviated wells.

Each of the nose 15, the knuckle joints 17, the instrument housing 19, and the weight bars 23 has a plurality of external rollers 31. The rollers 31 are independently mounted to the components such that outer portions of the rollers 31 are exposed relative to the exteriors of the components. The rollers 31 are free to roll in either direction with respect to the tool 11 when, for example, contact is made with inner surfaces of the well 13.

In one embodiment, each of the rollers 31 comprises a flat circular disk or wheel (FIGS. 2 and 3) that is mounted within a slot 33 in one of the components. The slots 33 are typically semi-circular and sealed such that well fluids do not enter the components beyond the slots 33 themselves. Each of the rollers 31 is mounted on a pin 35 in a respective one of the slots 33, such that the rollers 31 are free to rotate in both directions relative to respective ones of the pins 35. In one embodiment, the pins are perpendicular to the longitudinal axis of the nose 15.

As shown in FIG. 1, the instrument housing 19 may further comprise, for example, a cylindrical sealed cage containing the electronic gauge 21 that is located within the instrument housing. As best shown in FIG. 2, one embodiment of each of the knuckle joints 17 has an upper cylindrical portion 41 and a lower cylindrical portion 43 that are interconnected by a swivel 45. The swivel 45 allows 360° movement of the upper and lower cylindrical portions 41, 43 relative to each other. In one embodiment, the rollers 31 on each knuckle joint 17 are mounted to one of the cylindrical portions 41, 43 (e.g., lower cylindrical portion 43, in the embodiment shown), with the other cylindrical portion 41, 43 being free of rollers 31. This design gives the knuckle joint 17 multiple degrees of freedom in rotational flexibility.

The set of rollers 31 on each of the nose 15, the knuckle joints 17, the instrument housing 19, and the weight bars 23 may comprise many different configurations. In one embodiment, at least three rollers 31 are provided on each of the nose 15, the knuckle joints 17, the instrument housing 19, and the weight bars 23. Each of three rollers 31 in a single set of the rollers is circumferentially spaced apart from the other two rollers in the set by, for example, 120°. When four rollers 31 are provided in each set of the rollers, the rollers 31 may be spaced apart from adjacent ones of the rollers by 90°.

Figure 4:
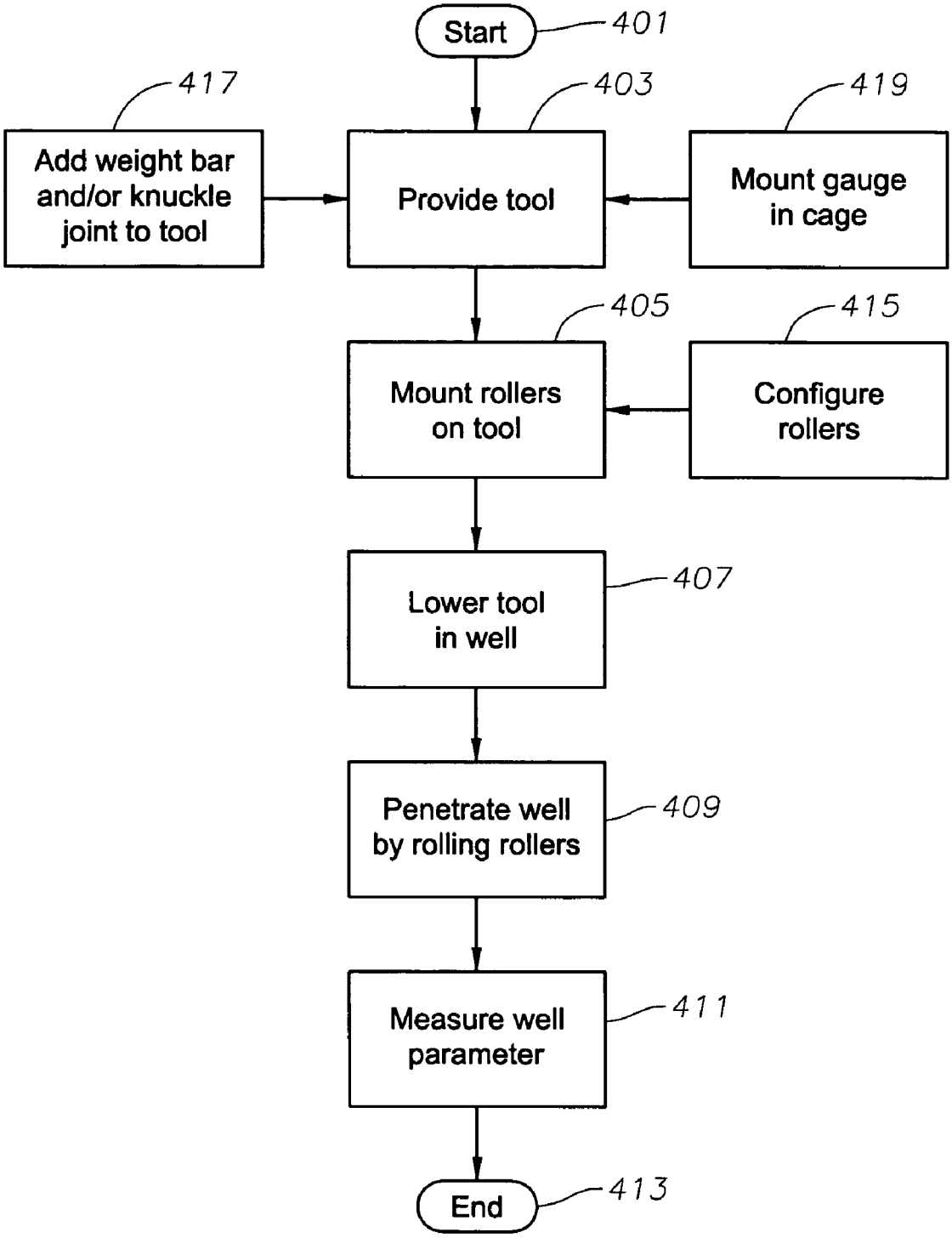
FIG. 4 is a high level flow diagram of one embodiment of a method constructed in accordance with the present invention.

Referring now to FIG. 4, one embodiment of the present invention also comprises a method of surveying a well 13. As shown at step 401, the method begins and comprises providing a wireline survey tool 11 (step 403) with a nose 15, an instrument housing 19 containing an electronic gauge 21 for measuring a parameter of the well 13, and a knuckle joint 17 between the nose 15 and the instrument housing 19. The method further comprises mounting a plurality of rollers 31 (step 405) to each of the nose 15, the knuckle joint 17, and the instrument housing 19, and lowering the wireline survey tool 11 into the well 13 (step 407) such that the nose 15 articulates relative to the instrument housing 19 via the knuckle joint 17.

In one embodiment, the method further comprises contacting inner surfaces of the well 13 with the rollers 31 and rolling the rollers 31 (step 409) relative to the wireline survey tool 11 to facilitate deeper movement of the wireline survey tool 11 into the well 13, and then taking a measurement of the well 13 (step 411) with the electronic gauge 21 before ending at step 413.

The method may further comprise configuring each of the rollers 31 (step 415) as a circular disk mounted within a slot 33. In addition, the method may further comprise: adding at least one weight bar 23 (step 417) of length greater than the knuckle joint 17 for additional weight for the wireline survey tool 11; positioning a second knuckle joint 17 between said at least one weight bar 23 and the instrument housing 19 to allow articulation of the instrument housing 19 relative to the weight bar 23; and configuring said at least one weight bar 23 and the second knuckle joint 17 with rollers 31 that contact and roll against inner surfaces of the well.

One embodiment of the method of the present invention further comprises configuring each of the rollers 31 (step 415) as a circular disk and mounting each of the rollers 31 on a pin 35 in a slot 33 such that the rollers 31 rotate relative to respective ones of the pins 35. The method may further comprise mounting the electronic gauge 31 in a cylindrical sealed cage (step 419) that is located within the instrument housing 19. Furthermore, the method may comprise configuring each of the rollers 31 (step 415) on the nose 15 as a circular disk mounted on a pin 35 in a slot 33, such that the rollers 31 rotate relative to respective ones of the pins 35, and the pins 35 are perpendicular to an axis of the nose 15.

As described above, the components may be configured in many different ways, including at least three rollers 31 on each of the nose 15, the knuckle joint 17, and the instrument housing 19, each of said at least three rollers being circumferentially spaced from the other two rollers of said at least three rollers.

The knuckle joint 17 may be configured with an upper cylindrical portion 41 and a lower cylindrical portion 43 interconnected by a swivel 45 that allows 360° movement of the upper and lower cylindrical portions 41, 43 relative to each other; and mounting the rollers 31 to one of the cylindrical portions 41, 43, the other cylindrical portion 41, 43 being free of rollers 31. The method may further comprise configuring the knuckle joint 17 with multiple degrees of freedom in rotational flexibility.

The present invention has several advantages, including the ability to provide a highly flexible, wireline survey tool with roller knuckle joints that enable the survey tool string to penetrate and survey highly deviated wells. The present invention surveys horizontal wells having inclinations of up to about 85° from vertical. This design allows production engineers to conduct temperature and pressure surveys in highly inclined wells having small radii of curvature to determine the their condition.

In one version, the survey tool string uses a combination of axial components having very short axial lengths and external wheels that are free to roll when they make contact with the inner surfaces of the well. The wheels act as both friction-reducing elements and stand-offs for the survey tool string with respect to the inner surfaces of the well. The stand-off feature of the survey tool enables the gauge to make more accurate surveys. Specifically, each component and the overall string itself is much shorter in axial length than prior art designs.

While the invention has been shown or described in only some of its forms, it should be apparent to those skilled in the art that it is not so limited, but is susceptible to various changes without departing from the scope of the invention.

What is claimed is:

1. A wireline survey tool for surveying deviated wells, comprising:

a nose having a rounded lower end;

a knuckle joint connected to the nose;

an instrument housing connected to the knuckle joint opposite the nose such that the nose articulates relative to the instrument housing, the instrument housing containing an electronic gauge for measuring a parameter of the well; and each of the nose, the knuckle joint, and the instrument housing having a plurality of rollers mounted thereto that are free to roll when contact is made with inner surfaces of the well.

2. The wireline survey tool of claim 1, wherein each of the rollers comprises a circular disk mounted within a slot.

3. The wireline survey tool of claim 1, further comprising:

at least one weight bar of length greater than the knuckle joint for adding weight to the tool;

a second knuckle joint located between said at least one weight bar and the instrument housing, allowing articulation of the instrument housing relative to the weight bar; and said at least one weight bar and the second knuckle joint each have a rollers mounted thereto that are free to roll when contact is made with inner surfaces of the well.

4. The wireline survey tool of claim 1, wherein each of the rollers is a circular disk mounted on a pin in a slot, such that the rollers are free to rotate relative to respective ones of the pins.

5. The wireline survey tool of claim 1, further comprising a cylindrical sealed cage containing the electronic gauge and located within the instrument housing.

6. The wireline survey tool of claim 1, wherein each of the rollers on the nose is a circular disk mounted on a pin in a slot such that the rollers are free to rotate relative to respective ones of the pins, the pins being perpendicular to an axis of the nose.

7. The wireline survey tool of claim 1, wherein the knuckle joint has an upper cylindrical portion and a lower cylindrical portion interconnected by a swivel that allows 360° movement of the upper and lower cylindrical portions relative to each other; and the rollers are mounted to one of the cylindrical portions, the other cylindrical portion being free of rollers.

8. The wireline survey tool of claim 1, wherein the knuckle joint has multiple degrees of freedom in rotational flexibility.

9. The wireline survey tool of claim 1, wherein the plurality of rollers on each of the nose, the knuckle joint, and the instrument housing comprises at least three rollers on each of the nose, the knuckle joint, and the instrument housing, each of said at least three rollers being circumferentially spaced from the other two rollers in said at least three rollers.

10. A wireline survey tool for surveying deviated wells, comprising:

a nose;

a plurality of knuckle joints for enhancing articulation of the tool;

a plurality of weight bars, each having a length greater than a length of one of the knuckle joints for adding weight to the tool;

an instrument housing connected to the knuckle joint opposite the nose such that the nose articulates relative to the instrument housing, the instrument housing containing a temperature or pressure gauge for measuring an associated parameter of wells; and each of the nose, the knuckle joints, the weight bars, and the instrument housing having a plurality of circumferentially spaced apart wheels mounted thereto for longitudinal rolling movement in wells.

11. The wireline survey tool of claim 10, wherein a knuckle joint is located between adjacent ones of the weight bars.

12. The wireline survey tool of claim 10, wherein a knuckle joint is located between a lowermost one of the weight bars and the instrument housing.

13. The wireline survey tool of claim 10, wherein a knuckle joint is located between the instrument housing and the nose.

14. The wireline survey tool of claim 10, wherein each of the wheels is a flat circular disk mounted on a pin in a slot such that the wheels are free to rotate relative to respective ones of the pins.

15. The wireline survey tool of claim 10, further comprising a cylindrical sealed cage containing the temperature or pressure gauge and located within the instrument housing.

16. The wireline survey tool of claim 10, wherein each of the wheels on the nose is a circular disk mounted on a pin in a slot such that the wheels are free to rotate relative to respective ones of the pins, the pins being perpendicular to an axis of the nose.

17. The wireline survey tool of claim 10, wherein each of the knuckle joints has an upper cylindrical portion and a lower cylindrical portion interconnected by a swivel that allows 360° movement of the upper and lower cylindrical portions relative to each other; and the wheels are mounted to one of the cylindrical portions, the other cylindrical portion being free of wheels.

18. The wireline survey tool of claim 10, wherein the knuckle joint has multiple degrees of freedom in rotational flexibility.

19. A method of surveying a well, comprising:

providing a wireline survey tool with a nose, an instrument housing containing an electronic gauge for measuring a parameter of the well, and a knuckle joint between the nose and the instrument housing;

mounting a plurality of rollers to each of the nose, the knuckle joint, and the instrument housing and configuring each of the rollers as a circular disk mounted within a slot;

lowering the wireline survey tool into the well such that the nose articulates relative to the instrument housing via the knuckle joint;

contacting inner surfaces of the well with the rollers and rolling the rollers relative to the wireline survey tool to facilitate deeper movement of the wireline survey tool into the well; and then taking a measurement in the well with the electronic gauge.

20. The method of claim 19, further comprising:

adding at least one weight bar of length greater than the knuckle joint for additional weight for the wireline survey tool;

positioning a second knuckle joint between said at least one weight bar and the instrument housing to allow articulation of the instrument housing relative to the weight bar; and configuring said at least one weight bar and the second knuckle joint with rollers that contact and roll against inner surfaces of the well.

21. The method of claim 19, further comprising configuring each of the rollers as a circular disk and mounting each of the rollers on a pin in a slot such that the rollers rotate relative to respective ones of the pins.

22. The method of claim 19, further comprising mounting the electronic gauge in a cylindrical sealed cage that is located within the instrument housing.

23. The method of claim 19, further comprising configuring each of the rollers on the nose as a circular disk mounted on a pin in a slot, such that the rollers rotate relative to respective ones of the pins, and the pins are perpendicular to an axis of the nose.

24. The method of claim 19, further comprising configuring the knuckle joint with an upper cylindrical portion and a lower cylindrical portion interconnected by a swivel that allows 360° movement of the upper and lower cylindrical portions relative to each other; and mounting the rollers to one of the cylindrical portions, the other cylindrical portion being free of rollers.

25. The method of claim 19, further comprising configuring the knuckle joint with multiple degrees of freedom in rotational flexibility.

26. The method of claim 19, further comprising configuring the plurality of rollers on each of the nose, the knuckle joint, and the instrument housing with at least three rollers on each of the nose, the knuckle joint, and the instrument housing, each of said at least three rollers being circumferentially spaced from the other two rollers of said at least three rollers.

* * * * *